United States Patent [19]

Davis

[11] Patent Number: 4,721,163

[45] Date of Patent: Jan. 26, 1988

[54] SUBSEA WELL HEAD ALIGNMENT SYSTEM

[75] Inventor: Peter J. R. Davis, Aberdeen, Scotland

[73] Assignee: Texaco Limited, London, England

[21] Appl. No.: 834,167

[22] Filed: Feb. 27, 1986

[30] Foreign Application Priority Data

Mar. 1, 1985 [GB] United Kingdom ..... 8505328

[51] Int. Cl.[4] ..... E21B 23/00; E21B 33/043

[52] U.S. Cl. ..... 166/341; 166/85; 166/97.5; 166/237; 166/348

[58] Field of Search ..... 166/341–345, 166/348, 77.5, 85, 97.5, 237; 285/24–29, 137.2; 405/224, 269

[56] References Cited

U.S. PATENT DOCUMENTS

| | | | |
|---|---|---|---|
| 3,347,311 | 10/1967 | Word, Jr. | 166/344 |
| 3,353,595 | 11/1967 | Nelson et al. | 166/341 |
| 3,500,906 | 3/1970 | Petersen | 166/341 |
| 3,536,342 | 10/1970 | Hull et al. | 285/27 |
| 4,067,385 | 1/1978 | Schwager et al. | 166/343 |
| 4,214,778 | 7/1980 | Diehl | 285/137.2 X |

FOREIGN PATENT DOCUMENTS

| | | | |
|---|---|---|---|
| 1158935 | 7/1969 | United Kingdom | 166/343 |

*Primary Examiner*—James A. Leppink
*Assistant Examiner*—Hoang C. Dang
*Attorney, Agent, or Firm*—Robert A. Kulason; James J. O'Loughlin; Robert B. Burns

[57] ABSTRACT

A tubing hanger alignment system for a subsea well, periodically subjected to treatment by removing the well tubing and inserting treating tools therein, wherein a tubing guidance system cooperating with the wellhead for engaging a downwardly moving tubing hanger running system thereby to rotate said tubing hanger sufficiently to position the carried tubing at a predetermined relationship with the wellhead, thereby providing access into the tubing hanger for sealing elements of an over-positioned subsea tree co-operative with the wellhead.

6 Claims, 6 Drawing Figures

SUBSEA WELL HEAD ALIGNMENT SYSTEM

In any well formed into a subterranean reservoir for producing a liquid or gas or for the injection of water for reservoir pressure support, the well normally comprises a series of concentric steel casings extending into the earth, the smallest diameter casing being cemented deepest into the well. This smallest diameter casing may subsequently accommodate an inserted length of tubing through which the reservoir fluids will be produced, or down which injection water will be forced.

A well such as that described above will normally be periodically worked over. Such an operation potentially includes initially the removal of the xmas tree and production (or water injection) tubing. The subsequent treating of the well can then be carried out to achieve a particular function. Thereafter the tubing is replaced, the xmas tree reconnected to the tubing, and the well will usually perform at an improved rate. Such is the case with both land based wells, and subsea wells, in which the xmas tree (or 'subsea tree') is located just above the seabed.

It is a fundamental operational requirement that access to the annular area between the tubing and the casing is able to be effected through the subsea tree and tubing hanger.

The annular area can be accessed in the case of (1) concentric bore tubing hanger, through an annular sealing arrangement around a central tubing bore porting; (2) eccentric bore tubing hanger, through a separate porting in the tubing hanger eccentric to the main tubing bore porting.

What is presently disclosed, is an improved eccentric tubing hanger orientation system for subsea wells whereby one, two or three downwardly suspended tubings for production or liquid injection, are supported from a tubing hanger within a wellhead casing. Means however, is provided for initially guiding the downwardly moving tubing hanger in such a manner that when seated and locked in place within the wellhead housing, the tubing hanger will be at a predetermined known disposition. Thereafter, as the subsea tree is guidably lowered on to the wellhead, the tree's downward extending stab conduits will register within the upward facing, prepositioned tubing and annulus access receptacles within the tubing hanger.

It is therefore an object of the invention to provide a tubing hanger alignment system for a subsea well which permits the accurate orientation of an eccentric bore tubing hanger which is suspended in the wellhead.

The guide means comprises an orientation apparatus or tool which is mounted on the wellhead during a completion or workover operation such that a guide key or detent is actuated relative to the tubing hanger by controlled insertion or retraction thereof.

An embodiment of the invention will now be described by way of example and with reference to the accompanying drawings, in which.

Figure 1:
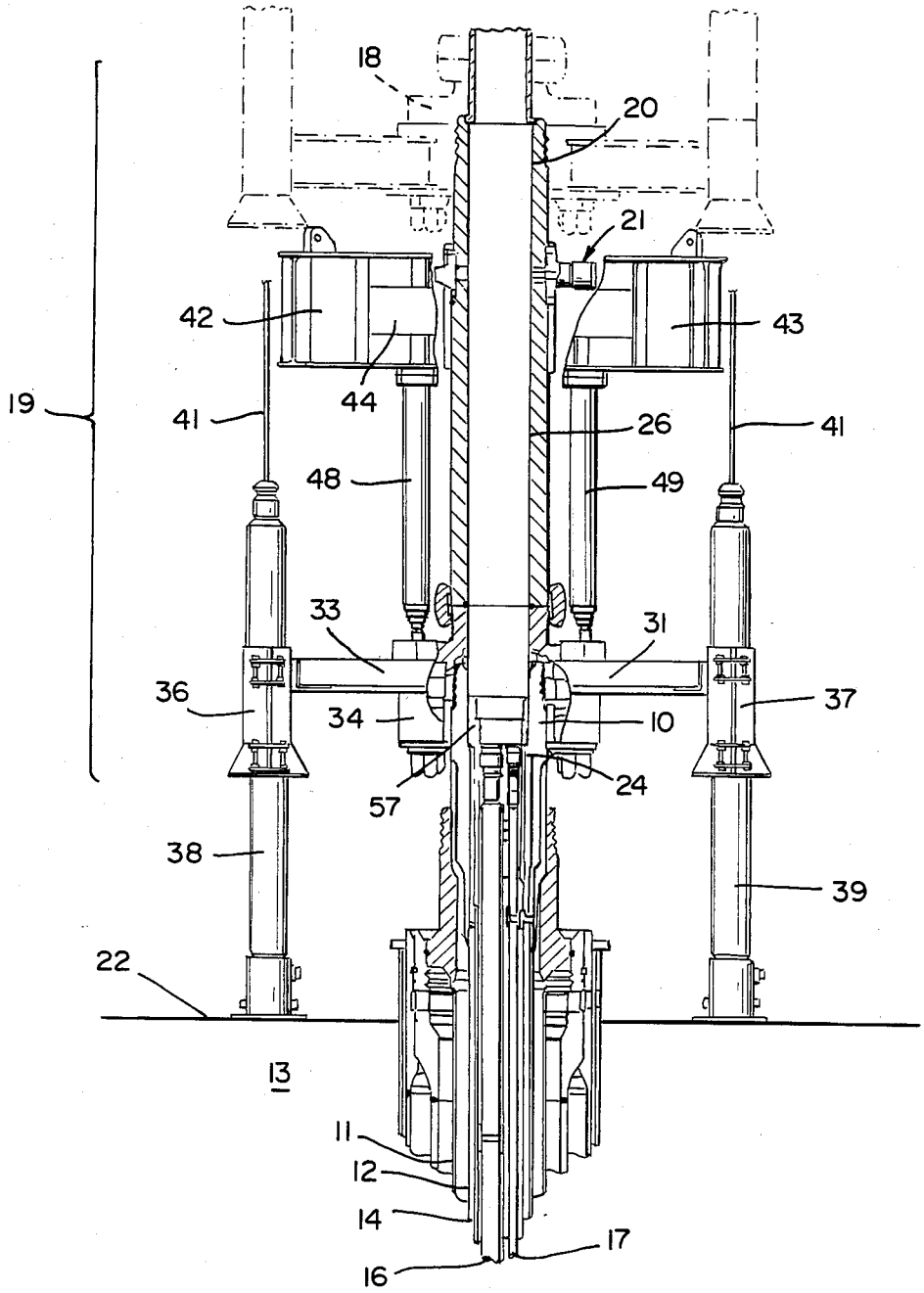
FIG. 1 is a vertical elevation view of a subsea well head shown partially in cross-section to illustrate internal parts including an alignment system according to the present invention.

As shown in FIG. 1, a subsea well and wellhead 10 of the type presently contemplated, is comprised primarily of a series of elongated casings 11 and 12 which are inserted into and are cemented into a substrate 13. The casings are of progressively smaller diameter whereby to subsequently surround a portion of the smallest or inner casing 14. The latter in turn encloses the tubing 16 and 17 used to complete the well. Wells of this type, that are located at an offshore site, are normally provided with means for guidably positioning both a subsea tree and/or a blowout preventer on to the wellhead itself.

The well is provided with a tubing guidance or orientation system 19, comprising primarily an orientation spool having an elongated column which is connected to, and extends upwardly from the wellhead housing in such manner to define an elongated, central tube guide passage. The upper end of the column is provided with an external profile 20 to which a blowout preventer 18 can be connected. The column is in turn provided with a detent means 21 positioned in the wall thereof and comprises an actuator for operably positioning a detent key. The key is selectively either inserted into or retracted from the central guide passage within the column.

Figure 2:
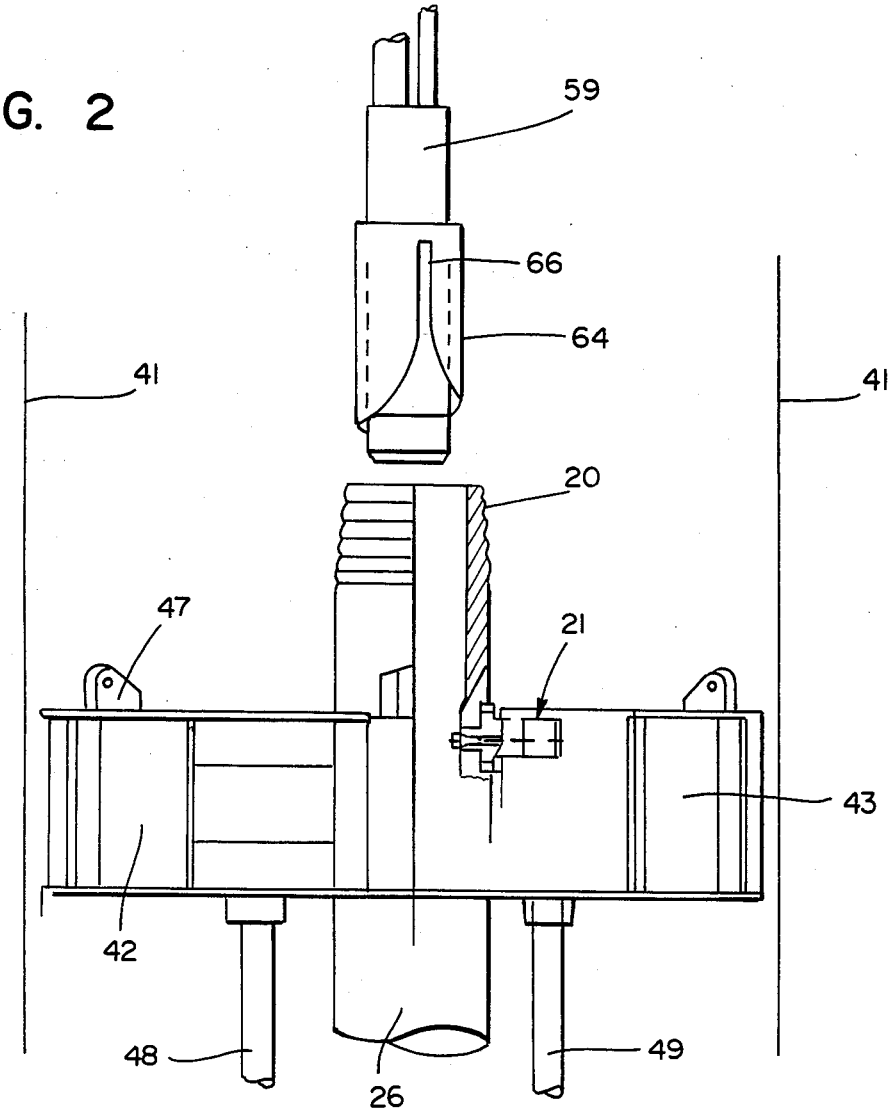
FIG. 2 is a detail of FIG. 1 with portions removed to illustrate the alignment system.
Figure 3:
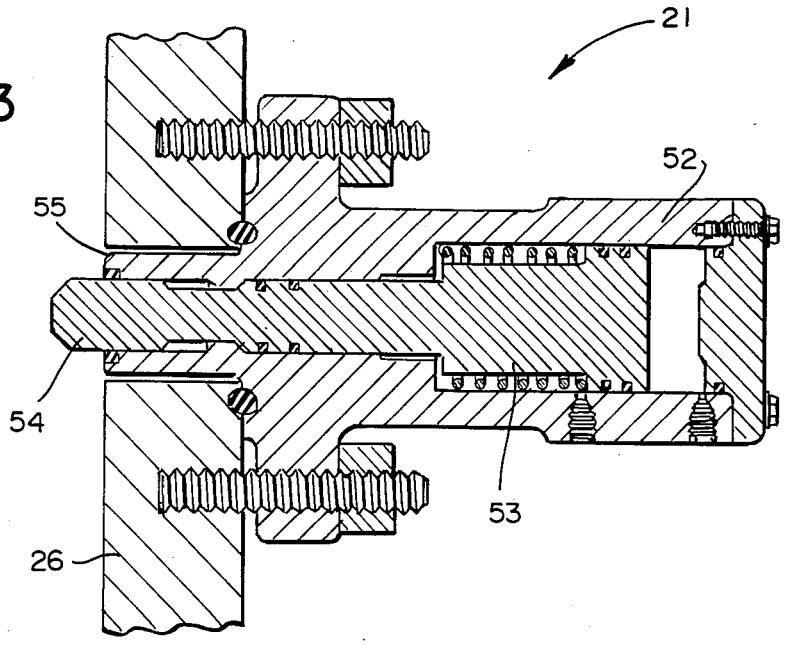
FIG. 3 is a segmentary cross-sectional detail on an enlarged scale showing a portion of the system of FIG. 2.

The function of said key, when in the inserted position, is to engage a helical shoe or cam-like arrangement 64 which, as indicated in FIG. 2, is formed on the outer surface of a segment of a tubing hanger running assembly 59. Thus, as the running assembly 59 is lowered into the well, the helical shoe will engage the actuated key thus causing the entire tubing string and tubing hanger to be rotated into a particular orientation.

Thereafter as a subsea tree is lowered onto the wellhead, the tree's downward extending stab conduits 61 and 62 will register with, and engage, the upwardly facing production and annulus access receptacles within the tubing hanger 57.

Referring again to FIG. 1, a well of the type herein contemplated is formed at a site in an offshore body of water in such manner that wellhead 10 projects a predetermined height above the guidance structure 22.

The casings such as 11 and 12, are held in place to define a progressively decreasing central passage which terminates in a production casing 14 wherein completion tubulars 16 and 17 are enclosed. Tubulars 16 and 17 are held in place on tubing hanger 57 which is in turn set by a circular locking ring 24.

A tubing guidance or orientation system comprises primarily an Orientation Spool 19 having a base or foundation which can be removably fixed to wellhead housing 10. A column 26 extends upwardly from the wellhead housing 10 to form an intermediate member between the wellhead and the drilling blowout preventer which will sealably but detachably engage the upper end of upstanding column 26.

The lower end of said column 26 includes remotely operated connector 34 adapted to sealably grasp wellhead housing 10. Column 26 thereby defines a central passage which extends axially of the wellhead 10.

Orientation Spool 19 in one embodiment includes a foundation framework 31 at the lower end formed of a peripheral outer ring from which a plurality of radial arms 32 and 33 depend, to support a remotely operated connector 34 at the foundation center. Said connector 34 is remotely actuated into its engaged position on the wellhead 10 after being lowered into engagement with the latter.

Foundation framework 31 is provided with a plurality of peripheral guide funnels 36 and 37. Said funnels are disposed in substantial vertical alignment and adapted to slidably engage a guide cable and guide post toward properly orienting and engaging spool 19 with the wellhead 10.

A plurality of guide posts 38 and 39 are equispaced radially about the wellhead 10, each forming an anchor for an upwardly supported guide cable 41. The respective posts 38 and 39 are fixed in position relative to the wellhead 10 equispaced from the centre thereof in position to receive the correspondingly placed guide funnels such as 36 and 37 of equipment which is subsequently lowered onto wellhead 10.

The upper end of the Orientation Spool is provided with a transverse support beam structure 42 and 43 which depends outwardly from column 26 and is laterally supported by spacer arms 44 and 46 extending between the respective structure segments. The support beam structure allows the Orientation Spool to hang from the drilling rig's blowout preventer handling system while the blowout preventer is sealably made up to the Orientation Spool at the surface. To facilitate surface handling and transportation said transverse support structure includes lifting eyes 47 at the outer edges to accommodate cables or other lifting means. The transverse brackets are spaced upwardly from foundation framework 31 by plurality of vertical braces 48 and 49.

The detent mechanism 21 incorporated into the Orientation Spool 19 is flanged sealably to column 26. The actuator 21 as shown comprises a casing 52 which slidably encloses a piston 53 having key 54 on the remote end thereof. Key 54 is positioned to register within opening 55 formed in the wall of column 26.

Detent mechanism 21 is communicated with a remotely actuated source of power whereby to selectively urge key 54 in a manner to insert it through opening 55 for a limited distance into the central passage of column 26.

Key actuator 21 in one embodiment is comprised of a hydraulic cylinder having a piston slidably mounted therein for reciprocal movement. Thus casing 52 is communicated with a hydraulic pump on the overpositioned drilling rig at the water's surface to be remotely controlled to achieve proper positioning of key 54.

Actuator 21 is so positioned relative to column 26 that when key 54 is withdrawn to the retracted position, the central passage through column 26 will be completely cleared to permit passage of downhole tubular goods.

Figure 4:
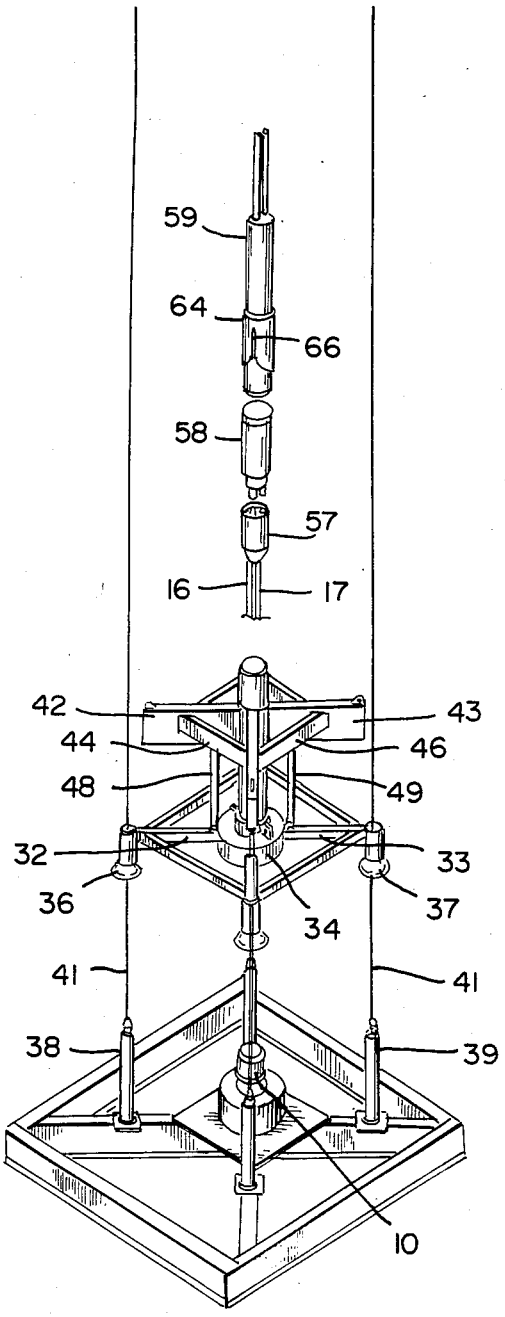
FIG. 4 is an exploded perspective view of the alignment system.

Referring to FIG. 4, the tubing hanger system comprises in brief tubing hanger 57, running tool 58, a tubing hanger running assembly 59, and the Orientation Spool 19. Said members are shown in a separated or exploded relationship to better illustrate the interaction prior to the completion tubes being lowered into a well.

Figure 5:
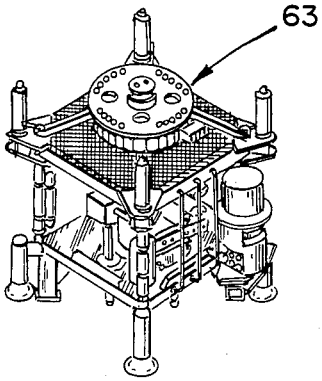
FIG. 5 is a perspective view of a subsea tree.
Figure 6:
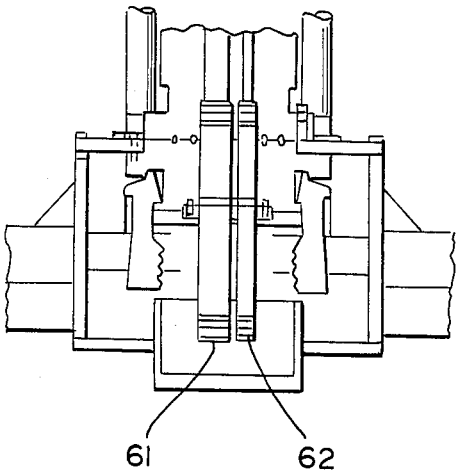
FIG. 6 is a vertical sectional view through the tree of FIG. 5.

Completion tubes 16 and 17 are attached to the underside of tubing hanger 57 which includes parallel passages communicated with the respective tubes. Since the latter are in the instant arrangement of two different sizes, the respective tube upper ends and their corresponding openings at the hanger 57 upper end must be prealigned to register with the corresponding downward extending slab conduits 61 and 62 of subsea tree 63, shown in FIGS. 5 and 6.

To achieve the desired tube alignment, tubing hanger 57 is lowered at the end of running tool 58, which is in turn supported by the tubing hanger running assembly 59. The lower end of the running assembly 59 is provided with guide shoe 64 which depends from the outer surface thereof. Shoe 64 is sufficiently raised from the outer surface to engage key 54 when the latter has been actuated to the extended or outward position.

*Shoe 64 is so contoured that its contact or rubbing* surface will slidably engage the protruding surface of key 54. As tubing hanger 57 approaches its seated location in the wellhead 10, initially some segment of the contoured shoe will engage the corresponding surface of key 54.

Continued lowering of the running string will then cause the string to be rotated so that key 54 will eventually register within the shoe's elongated docking slot 66. When this occurs, tubing hanger 57 will be set and locked in place by the locking ring 67. Tubes 16 and 17 will further be properly oriented so that the subsequent lowering of subsea tree 63 will permit the subsea tree's stab conduits 61 and 62 to sealably engage the corresponding tubing hanger 57 pockets for communicating with completion tubing 16 and 17.

The Orientation Spool 19 can remain in place on the well during any drilling or workover operations. It further expedites the completion phase of any well since tubing hanger 57 can be run in a single trip operation without encountering tubing aligning difficulties, a problem that is prevalent in resetting tubing in this type of well.

I claim:

1. The combination with a subsea well comprised of a well casing embedded into the ocean floor to define an elongated tubing passage enclosing tubing strings, and having a casing upper end at the ocean floor, a well head fixed to said well casing upper end adapted to removably receive a Christmas tree having downwardly extending fluid conduits engageable with said tubing strings, and a guide cable system extending between the well head and the water's surface to slidably guide equipment between the well head and the water's surface, of:

an orientation spool engaging said guide cable system and including an upstanding guide column removably engaging the well head, being aligned therewith to define a guide passage coaxially of said elongated tubing passage, a tubing hanger removably positioned within said well casing and supportably engaging said tubing strings with the upper ends thereof aligned in an upward direction, detent means movably mounted in said upstanding guide column, and being actuatable to retractably position a forward section thereof into the guide passage, and an elongated tubing running tool detachably engageable with said tubing hanger, to facilitate raising and lowering the latter through said guide passage, and having a guide shoe depending from the running tool lower end, whereby when actuated to an advanced position, said detent forward section will engage the running tool guide shoe to rotatably align the tubing hanger as the latter is lowered through the guide passage, thereby to align the respective tubing string upper ends for registry with the downwardly extending Christmas tree conduits when the Christmas tree is lowered along said cable system onto said well head.

2. A system as defined in claim 1, wherein said shoe surrounds a lower segment of the tubing hanger running system and includes a contoured surface positioned to engage said detent means.

3. A system as defined in claim 2, wherein said shoe includes a contoured contact surface that terminates in an elongated docking slot to receive said detent means.

4. A system as defined in claim 3, wherein said elongated docking slot is aligned substantially parallel with said column guide passage.

5. In the apparatus as defined in claim 1, wherein the upstanding guide column includes a port formed through a wall thereof, and said detent means depending from the column wall is in registry with said port.

6. In the apparatus as defined in claim 5, wherein said detent means includes a casing sealably engaging the upstanding column wall to sealably engage said column in alignment with said port, and a piston slidably carried on said casing and being actuatable for reciprocal motion between an advanced position, through said port, and a retracted position out of the guide passage, and a key formed at the piston forward section, of sufficient length to protrude into the column guide passage when said piston is actuated to the advanced position.

* * * * *